US009200427B2

(12) United States Patent
Phillips

(10) Patent No.: US 9,200,427 B2
(45) Date of Patent: Dec. 1, 2015

(54) DREDGING HEAD APPARATUS

(76) Inventor: Richard John Phillips, Crystal River, FL (US)

( * ) Notice: Subject to any disclaimer, the term of this patent is extended or adjusted under 35 U.S.C. 154(b) by 445 days.

(21) Appl. No.: 13/528,821

(22) Filed: Jun. 20, 2012

(65) Prior Publication Data

US 2013/0340298 A1 Dec. 26, 2013

(51) Int. Cl.

| | |
|---|---|
| ***E02F 3/88*** | (2006.01) |
| ***E02F 3/90*** | (2006.01) |
| ***E02F 3/92*** | (2006.01) |

(52) U.S. Cl.

CPC ..... *E02F 3/8841* (2013.01); *E02F 3/90* (2013.01); *E02F 3/902* (2013.01); *E02F 3/925* (2013.01); *E02F 3/9243* (2013.01); *E02F 3/9293* (2013.01)

(58) Field of Classification Search

CPC ..... E02F 3/889; E02F 3/92; E02F 3/9262; E02F 3/9293; E02F 3/88; E02F 3/8841; E02F 3/90; E02F 3/902; E02F 3/9092; E02F 3/9243

USPC ..... 37/320, 321, 335, 317

See application file for complete search history.

(56) References Cited

U.S. PATENT DOCUMENTS

| | | | | | |
|---|---|---|---|---|---|
| 371,686 | A | * | 10/1887 | Howell | 37/333 |
| 433,943 | A | * | 8/1890 | Humphreys | 37/335 |
| 477,827 | A | * | 6/1892 | Souther | 37/317 |
| 566,473 | A | | 8/1896 | Robinson | |
| 610,763 | A | * | 9/1898 | Kibling | 37/338 |
| 821,670 | A | * | 5/1906 | Parker | 37/321 |
| 1,254,357 | A | | 1/1918 | Reid | |
| 2,028,580 | A | * | 1/1936 | Yedd | 175/317 |
| 2,204,584 | A | | 6/1940 | Flower | |
| 2,205,490 | A | | 6/1940 | Peterson | |
| 2,280,066 | A | * | 4/1942 | Dorst | 37/333 |
| 2,413,561 | A | * | 12/1946 | Hehr | 37/323 |
| 3,152,409 | A | | 10/1964 | Ramsden et al. | |
| 3,248,812 | A | * | 5/1966 | Gardner | 37/314 |
| 3,273,664 | A | | 9/1966 | Ramer | |
| 3,504,943 | A | * | 4/1970 | Sheary et al. | 299/8 |
| 3,521,387 | A | | 7/1970 | Degelman | |
| 3,579,872 | A | | 5/1971 | Jantzen | |
| 3,624,933 | A | * | 12/1971 | Faldi | 7/320 |
| 3,738,029 | A | | 6/1973 | Harmon | |
| 3,755,932 | A | | 9/1973 | Cargile, Jr. | |
| 3,842,521 | A | * | 10/1974 | Faldi | 37/320 |
| 3,910,837 | A | * | 10/1975 | Good | 209/461 |
| 3,919,790 | A | | 11/1975 | Sasaki et al. | |
| 3,994,082 | A | * | 11/1976 | Faldi | 37/309 |
| 4,004,357 | A | * | 1/1977 | Faldi | 37/320 |
| 4,058,914 | A | * | 11/1977 | Kiss | 37/329 |
| 4,102,064 | A | | 7/1978 | Pot | |
| 4,227,323 | A | * | 10/1980 | Quigg et al. | 37/308 |
| 4,242,815 | A | | 1/1981 | Vermeulen | |

(Continued)

*Primary Examiner* — Thomas B Will
*Assistant Examiner* — Joan D Misa
(74) *Attorney, Agent, or Firm* — Law Office of Steven R. Olsen, PLLC; Steven R. Olsen

(57) ABSTRACT

In embodiments of the invention, a wheeled dredging head is configured to operate in a stand-alone condition, with the addition of a water jet assembly, and/or with the addition of an adapter at an intake of the dredging head. In one embodiment, the adapter is configured to vacuum the floor of a body of water. In another embodiment, the adapter is configured to remove sediment or other material from a sloped surface in a body of water. In yet another embodiment, the adapter is configured to remove sediment or other material from around obstacles in a body of water.

4 Claims, 7 Drawing Sheets

(56) References Cited

U.S. PATENT DOCUMENTS

| | | | | | |
|---|---|---|---|---|---|
| 4,267,652 | A | | 5/1981 | Senesac | |
| 4,311,066 | A | | 1/1982 | Schuhmann | |
| 4,311,342 | A | | 1/1982 | Latimer | |
| 4,351,122 | A | | 9/1982 | Cornelis et al. | |
| 4,352,250 | A | | 10/1982 | De Vries | |
| 4,352,251 | A | * | 10/1982 | Sloan | 37/323 |
| 4,418,484 | A | * | 12/1983 | Wolters et al. | 37/323 |
| 4,423,559 | A | * | 1/1984 | Malin | 37/335 |
| 4,585,274 | A | | 4/1986 | Grable | |
| 4,822,106 | A | * | 4/1989 | Wilson et al. | 299/9 |
| 4,839,061 | A | * | 6/1989 | Manchak, Jr. et al. | 210/743 |
| 4,887,371 | A | | 12/1989 | Kaiser | |
| 4,957,622 | A | * | 9/1990 | Mims | 210/170.04 |
| 5,421,105 | A | * | 6/1995 | Schulte | 37/309 |
| 5,970,635 | A | * | 10/1999 | Wilmoth | 37/323 |
| 6,966,132 | B1 | * | 11/2005 | Jacobsen et al. | 37/195 |
| 7,089,693 | B2 | * | 8/2006 | Collins et al. | 37/309 |
| 7,334,358 | B1 | * | 2/2008 | Whyte | 37/320 |
| 7,513,008 | B2 | | 4/2009 | Tucker | |
| 7,591,088 | B1 | * | 9/2009 | Schuh et al. | 37/311 |
| 7,621,059 | B2 | * | 11/2009 | McCoy et al. | 37/317 |
| 7,721,472 | B2 | | 5/2010 | Buhr et al. | |
| 7,892,438 | B2 | * | 2/2011 | Nielsen | 210/747.6 |
| 8,127,474 | B2 | | 3/2012 | Phillips | |
| 8,479,481 | B2 | * | 7/2013 | O'Toole et al. | 56/8 |
| 2003/0041483 | A1 | * | 3/2003 | Redding | 37/311 |
| 2003/0121182 | A1 | * | 7/2003 | Jacobsen et al. | 37/195 |
| 2010/0011627 | A1 | * | 1/2010 | Phillips | 37/320 |
| 2010/0175283 | A1 | * | 7/2010 | Pavan | 37/320 |
| 2014/0015302 | A1 | * | 1/2014 | Benedetti et al. | 299/9 |

* cited by examiner

DREDGING HEAD APPARATUS

BACKGROUND

1. Field of the Invention

The invention relates generally to a dredging head and more specifically, but without limitation, to a dredging head configured to receive an adaptor at an intake.

2. Description of the Related Art

Dredging is the process of removing sediments, sludge, aquatic plants, or other matter from a body of water (referred to herein as a slurry). Dredging may be performed in seas or fresh water, for instance to improve navigation, for mining purposes, and/or for the remediation of contaminated waters.

Various types of dredging apparatuses are known. Conventional dredging equipment is not effective in all conditions and applications, however. For example, most conventional dredges are configured to scrape the bed of the waterway. This may be undesirable where fragile aquatic ecosystems may be damaged or where bed liners exist. In addition, conventional dredging equipment often is not adapted to remove materials from sloped surfaces (such as the edge of a man-made pond) or from around docks or other obstacles.

For these and other reasons, improved dredging equipment is needed.

SUMMARY OF THE INVENTION

Embodiments of the invention seek to address one or more of the shortcomings described above with respect to conventional dredging equipment. In embodiments of the invention, a wheeled dredging head is configured to operate in a stand-alone condition, with the addition of a water jet assembly, and/or with the addition of an adapter at an intake of the dredging head. In one embodiment, the adapter is configured to vacuum the floor of a body of water; in another embodiment, the adapter is configured to remove sediment or other material from a sloped surface in a body of water; in yet another embodiment, the adapter is configured to remove sediment or other material from around obstacles in a body of water.

More specifically, one embodiment of the invention provides a dredging head that includes: a top plate having a first cutout; a bottom plate coupled to the top plate, a cavity being formed between the top plate and the bottom plate, the cavity having a side intake; a first suction pump coupled to the first cutout at an inlet port of the first suction pump; a first motor coupled to the first suction pump, the first motor configured to drive the first suction pump; and at least one wheel assembly coupled to the top plate and the bottom plate, the dredging head being further configured to receive an adapter at the side intake.

BRIEF DESCRIPTION OF THE DRAWINGS

The invention will be more fully understood from the detailed description below and the accompanying drawings, wherein.

DETAILED DESCRIPTION

Figure 1:
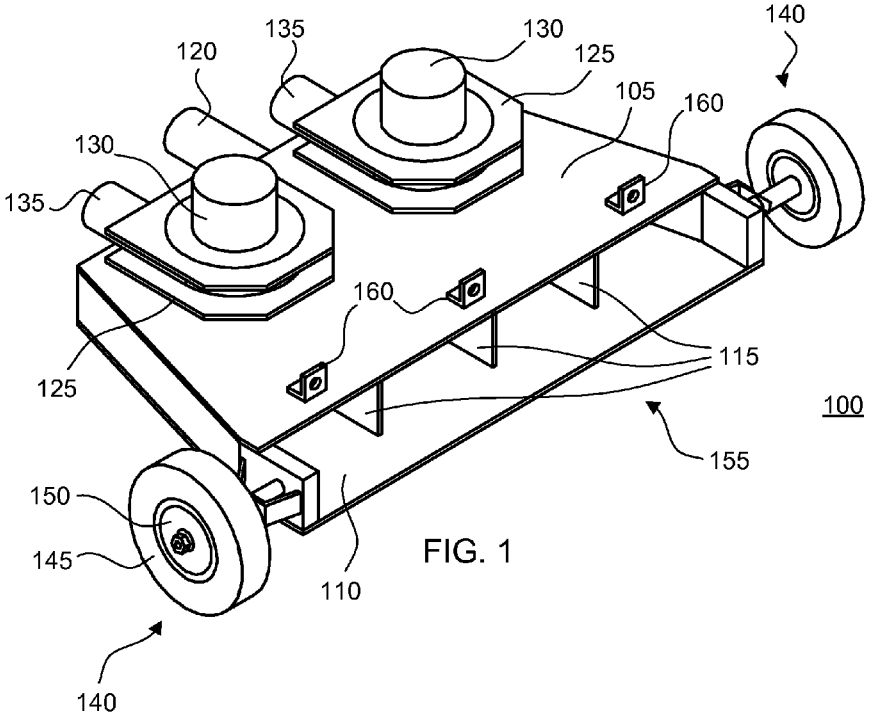
FIG. 1 is a perspective view of a dredging head, according to an embodiment of the invention.

Embodiments of the invention will now be described more fully with reference to FIGS. 1 through 12. This invention may, however, be embodied in many different forms and should not be construed as limited to the embodiments set forth herein. In the drawings, reference designators may be duplicated for the same or similar features. The figures are not necessarily drawn to scale; some features may be exaggerated for clarity.

FIG. 1 is a perspective view of a dredging head, according to an embodiment of the invention. As illustrated in FIG. 1, a dredging head 100 includes a top plate 105 positioned parallel to, and above, a bottom plate 110. Baffles 115 are disposed between the top plate 105 and the bottom plate 110. A boom coupling 120 is configured to couple the dredging head 100 to a boom (not shown). At least one suction pump 125 is disposed on a top surface of the top plate 105. The suction pump 125 includes an outlet port 135 and is powered by a hydraulic motor 130. The dredging head 100 also includes wheel assemblies 140. Each of the wheel assemblies 140 includes a tire 145 mounted to a wheel 150. The dredging head 100 preferably includes head mounting tabs 160 for coupling one or more adapters to an intake 155. As shown, the intake 155 is disposed on a side of the dredging head 100 between the top plate 105 and the bottom plate 110.

In operation, the dredging head 100 can be wheeled along the bed of a waterway using the boom coupling 120 and wheel assemblies 140. Slurry is received at intake 155. The slurry is directed between the baffles 115, pumped through the suction pumps 125, and discharged at the outlet ports 135. The outlet port 135 is preferably connected to a discharge hose (not shown).

Variations to the configuration of the dredging head 100 are possible. For example, one or more suction pumps 125 and associated hydraulic motors 130 may be used, according to design choice. The size or relative positioning of the wheels 150 and tires 145 may be varied, for example, to change an inclination angle or offset of the dredging head 100 with respect to the bed of a waterway. In addition, more or less baffles 115 may be used.

Figure 2:
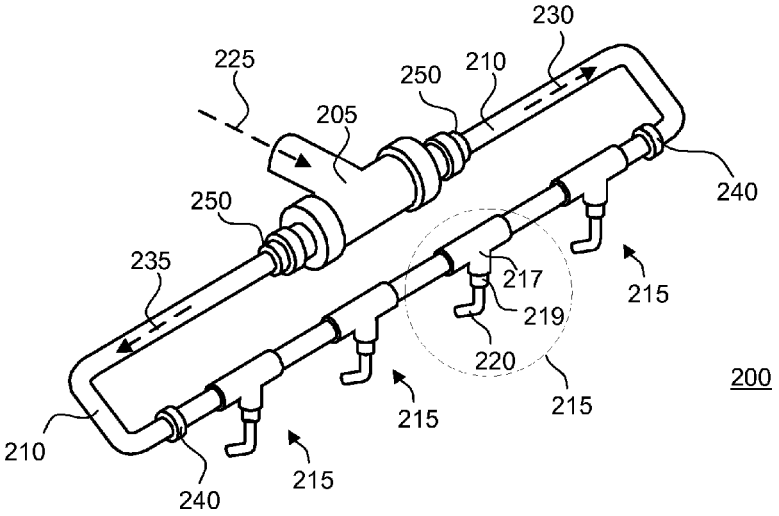
FIG. 2 is a perspective view of a water jet assembly, according to an embodiment of the invention.

FIG. 2 is a perspective view of a water jet assembly, according to an embodiment of the invention. As illustrated in FIG. 2, a water jet assembly 200 includes a splitter 205 coupled to a conduit 210. In the illustrated embodiment, multiple spray heads 215 are disposed along the conduit 210. Each of the spray heads 215 includes a T fitting 217, swivel compression fitting 219, and a nozzle 220. The conduit 210 may also include swivel compression fittings 240 and 250.

In operation, water is received from a water source in direction 225 into the splitter 205. Thereafter, water is distributed in the conduit 210 in directions 230 and 235 en route to the spray heads 215. The swivel compression fittings 240 and 250 allow for a wide range of adjustment in the configuration of the water jet assembly 200. In addition, the swivel compression fittings 219 permit directional changes to the nozzles 220.

Variations to the configuration illustrated in FIG. 2 are possible. For instance, other quantities of spray heads 215 may be used, according to application needs. Moreover, in alternative embodiments, fittings 219, 240, and/or 250 may not swivel.

Figure 3:
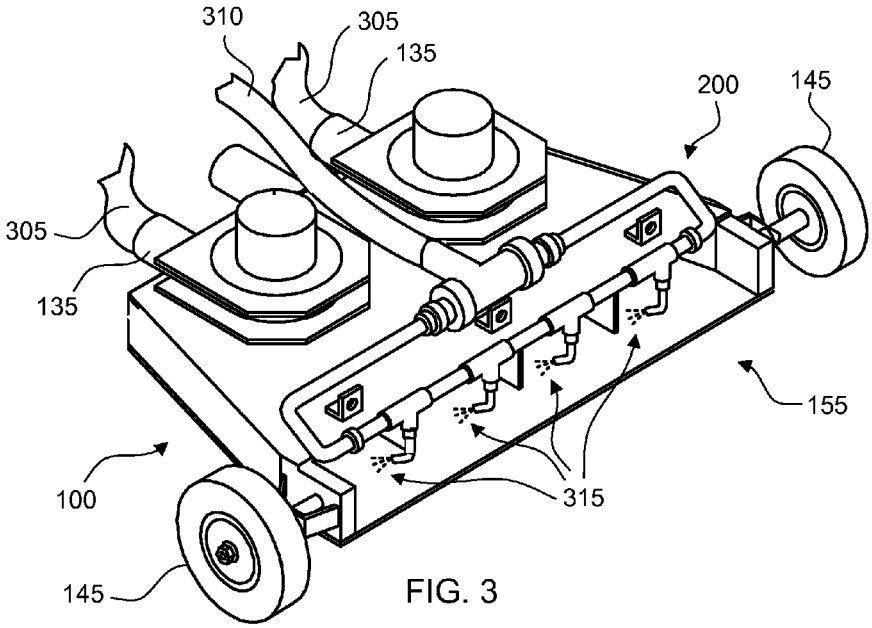
FIG. 3 is a perspective view of a dredging head that includes the water jet assembly illustrated in FIG. 2, according to an embodiment of the invention.

FIG. 3 is a perspective view of a dredging head that includes the water jet assembly illustrated in FIG. 2, according to an embodiment of the invention. As illustrated in FIG. 3, an operational configuration of a dredging head 100 with a water jet assembly 200 may also include water supply line 310 coupled to the water jet assembly 200, and discharge hoses 305 coupled to the outlet ports 135. In addition, in the illustrated configuration, water discharged from the spray heads 215 may be directed into the intake 155 of the dredging head 100. Such a configuration may be advantageous, for example, to increase the viscosity of the slurry being received in the intake 155. In other configurations, the spray heads 215 may be directed to a location in front of the intake 155 to soften sediments or other material being dredged. Alternatively, or in combination, one or more of the spray heads 215 may be directed ahead of the tires 145 to decrease a rolling resistance of the tires 145.

Figure 4:
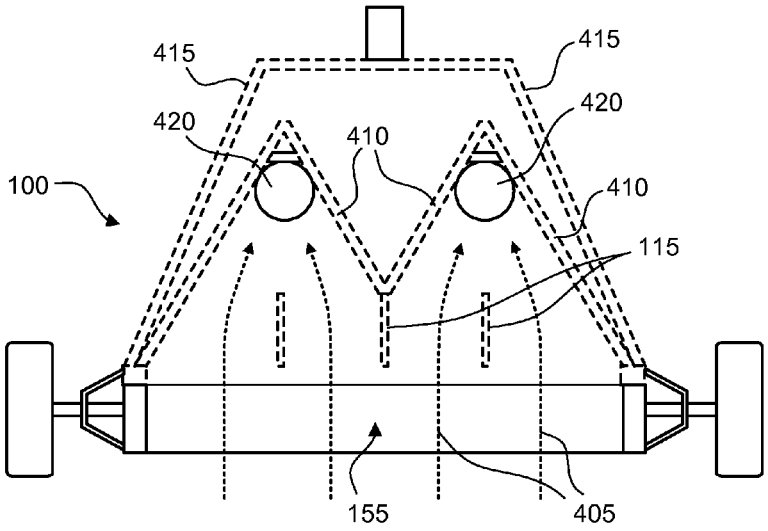
FIG. 4 is a plan view of a dredging head, illustrated to reveal features hidden below a top plate, according to an embodiment of the invention.

FIG. 4 is a plan view of a dredging head, illustrated to reveal features hidden below a top plate, according to an embodiment of the invention. As illustrated in FIG. 4, the dredging head 100 may include inner walls 410 between the top plate 105 and bottom plate 110. Outer walls 415 are also disposed between the top plate 105 and bottom plate 110 to provide additional structural support. Cutouts 420 are a feature of the top plate 105, and are configured to cooperate with inlet ports of the corresponding suction pumps 125.

In operation, the dredging head 100 receives slurry at the intake 155 in a direction 405 as directed by the inner walls 410 and baffles 115. Such material then passes through the cutouts 420 to corresponding inlets of the suction pumps 125. The configuration illustrated in FIG. 4 could be modified to accommodate a different number of suction pumps, according to application requirements.

Figure 5:
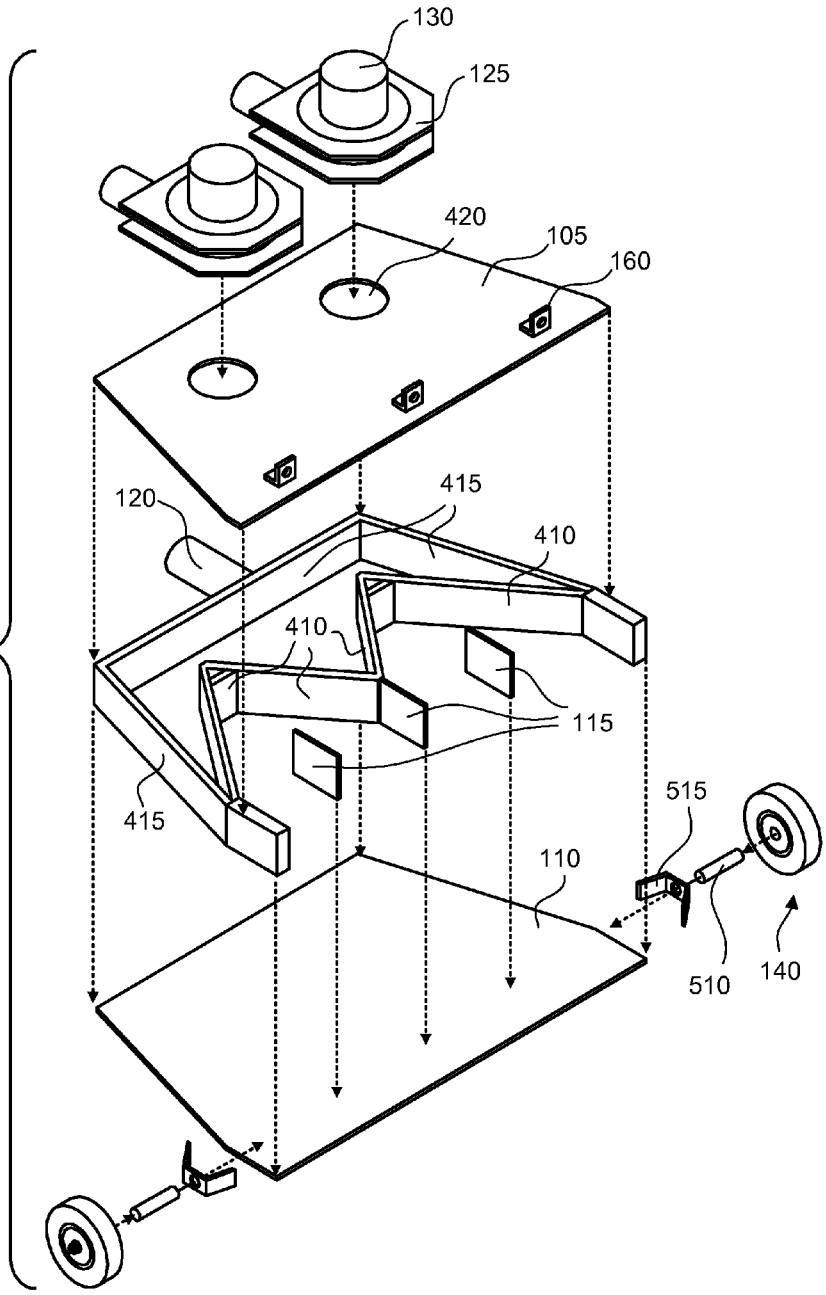
FIG. 5 is an exploded perspective view of a dredging head, according to an embodiment of the invention.

FIG. 5 is an exploded perspective view of a dredging head, according to an embodiment of the invention. As illustrated in FIG. 5, baffles 115, inner walls 410, and outer walls 415 are disposed between the top plate 105 and the bottom plate 110. In addition, boom coupling 120 may be coupled to the outer walls 415. Suction pumps 125 are coupled to the top plate 105 in cooperation with the cutouts 420. Head mounting tabs 160 are disposed on the top plate 105. Wheel assemblies 140 are coupled to outer walls 415 via axles 510. The axles 510 are supported by brackets 515.

Figure 6:
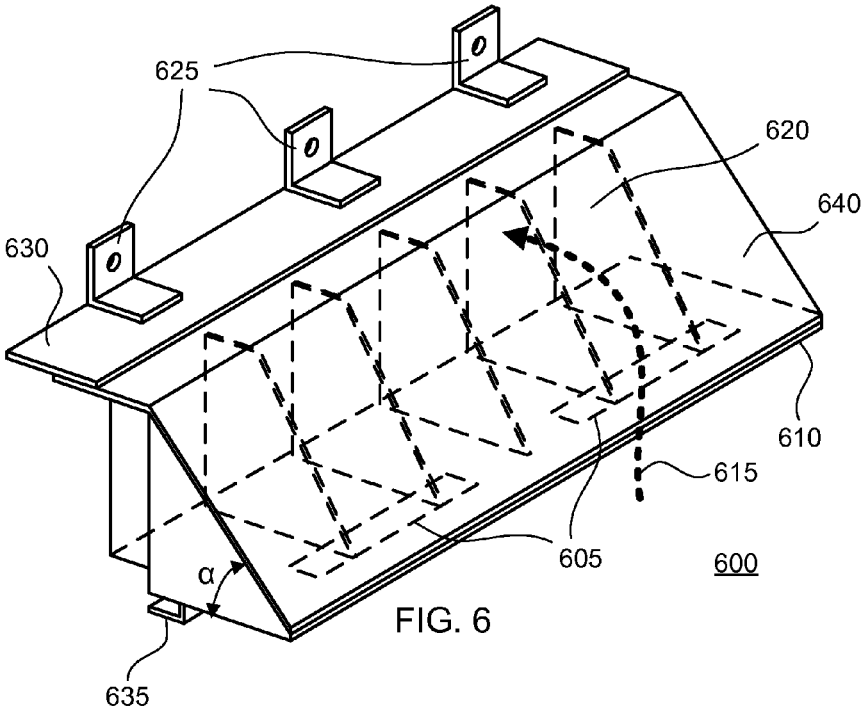
FIG. 6 is a perspective view of a floor adapter, according to an embodiment of the invention.

FIG. 6 is a perspective view of a floor adapter, according to an embodiment of the invention. FIG. 6 illustrates hidden features with dashed lines. A floor adapter 600 includes a base plate 610, a top plate 630 and front plate 640. The front plate 640 is preferably disposed at interior angle $\alpha$ that is less than 90 degrees with respect to the base plate 610 to achieve desired fluid flow characteristics. One or more apertures 605 are formed in the base plate 610. Baffles 620 are disposed internal to the floor adapter 600. Mounting tabs 625 are disposed on the top plate 630. Angle stock 635 is preferably disposed on a bottom side of the base plate 610.

The floor adapter 600 can be coupled to a dredging head 100 via the mounting tabs 625 and angle stock 635. The mounting tabs 625 are configured to cooperate with the head mounting tabs 160, and the angle stock 635 is configured to cooperate with the bottom plate 110. In operation, sediment or other material is received in a direction 615 through the apertures 605 and between the baffles 620. Such material is output from the floor adapter 600 to the intake 155 of the dredging head 100.

As can be appreciated, the number of apertures 605, baffles 620, and/or mounting tabs 625 could be varied, according to design choice.

Figure 7:
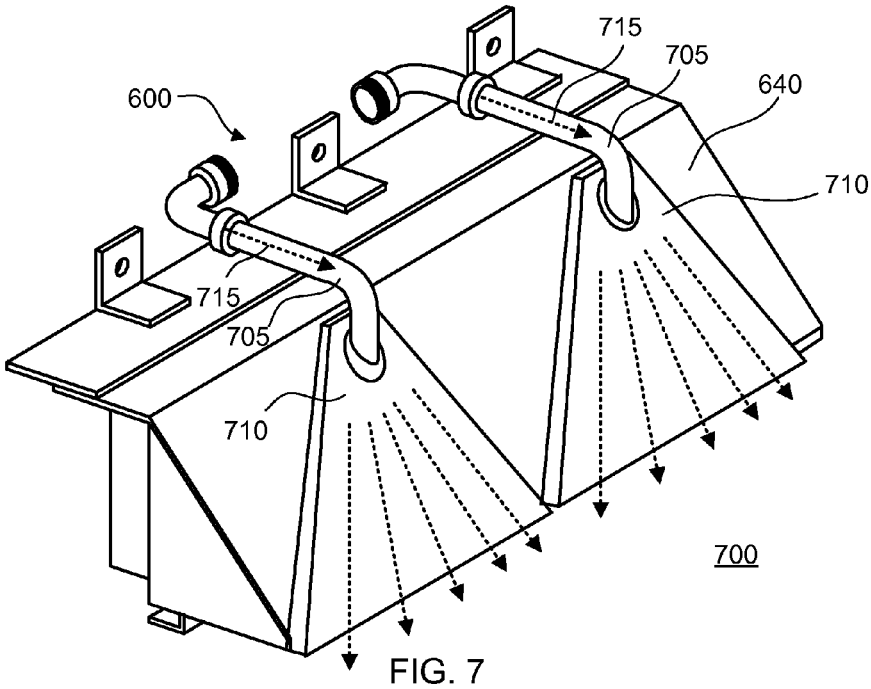
FIG. 7 is a perspective view of a modified floor adaptor, according to an embodiment of the invention.

FIG. 7 is a perspective view of a modified floor adaptor, according to an embodiment of the invention. As illustrated in FIG. 7, a modified floor adapter 700 includes a floor adapter 600 with the addition of one or more shrouds 710 and corresponding water lines 705.

In operation, water flows through the water lines 705 in a direction 715 to the shrouds 710. The water then exits a bottom portion of the shrouds 710 to soften sediments ahead of the modified floor adapter 700. Slurry is then collected as described above with reference to FIG. 6.

Figure 8:
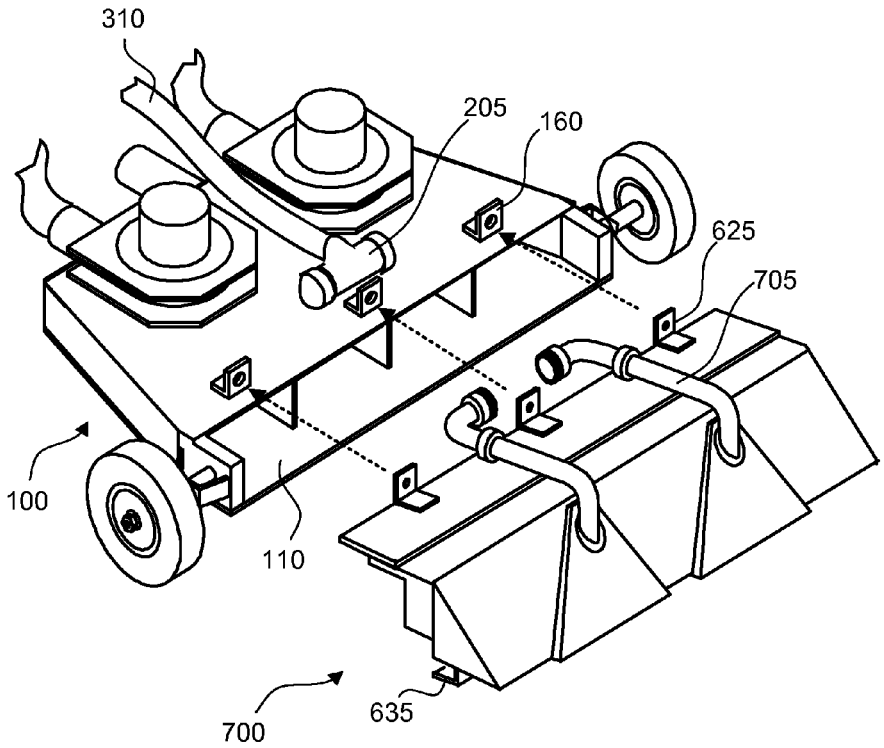
FIG. 8 is an assembly view of a dredging head and a modified floor adapter, according to an embodiment of the invention.

FIG. 8 is an assembly view of a dredging head and a modified floor adapter, according to an embodiment of the invention. As illustrated in FIG. 8, the modified floor adapter 700 is coupled to a dredging head 100 via the mounting tabs 625 and angle stock 635. The mounting tabs 625 are configured to cooperate with the head mounting tabs 160, and the angle stock 635 is configured to cooperate with the bottom plate 110.

Figure 9:
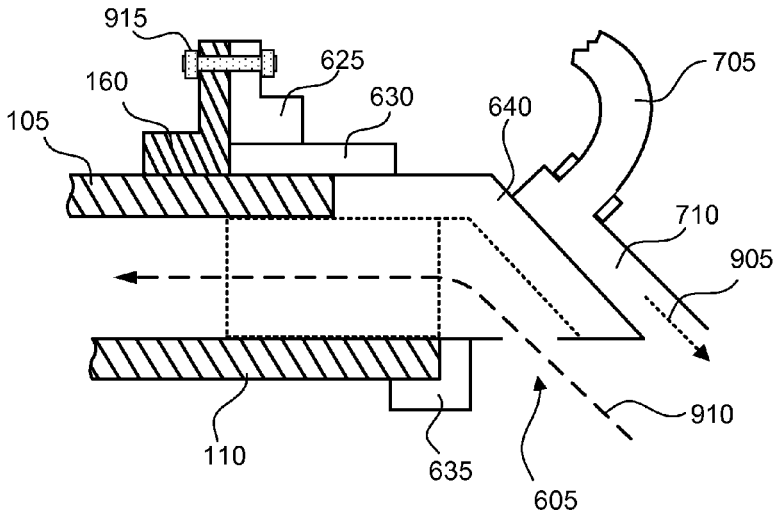
FIG. 9 is a cut-away elevation view of a modified floor adaptor assembled to a dredging head, according to an embodiment of the invention.

FIG. 9 is a cut-away elevation view of a modified floor adaptor assembled to a dredging head, according to an embodiment of the invention. FIG. 9 illustrates that a fastener 915 may be used to secure each mounting tab 635 to a corresponding head mounting tab 160. In operation, water may be supplied in a direction 905 via the water lines 705 and the shrouds 710. Slurry is received in a direction 910 through the modified floor adapter 700 and into the intake 155 of the dredging head 100.

Figure 10:
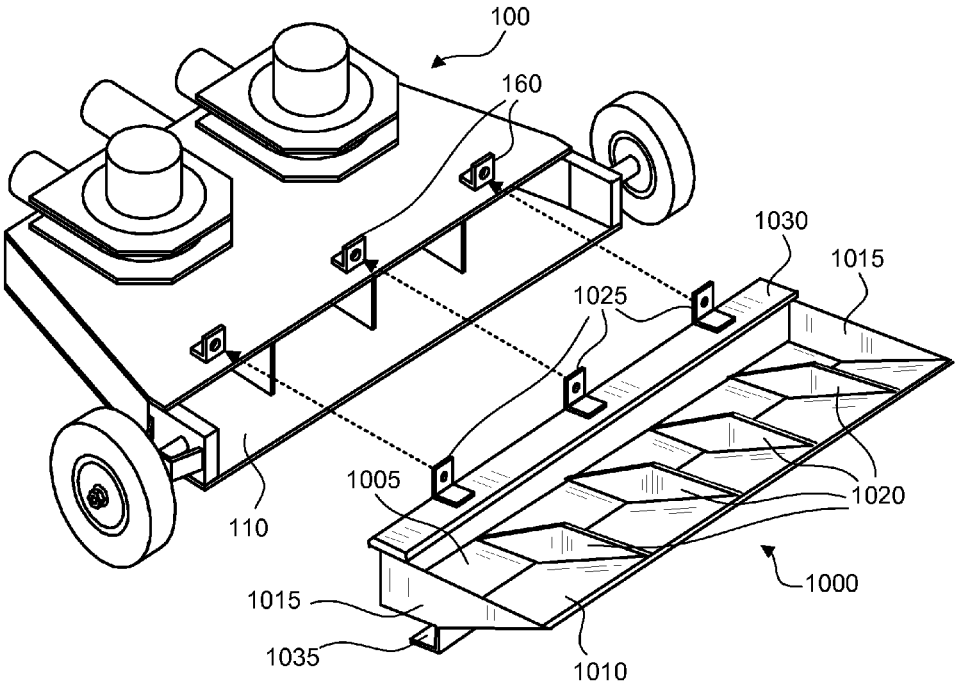
FIG. 10 is an assembly view of a dredging head and a slope adaptor, according to an embodiment of the invention.

FIG. 10 is an assembly view of a dredging head and a slope adaptor, according to an embodiment of the invention. As illustrated in FIG. 10, a slope adapter 1000 may be coupled to the dredging head 100. The slope adapter 1000 preferably includes a floor 1005, sloped front 1010, sides 1015, and baffles 1020. The mounting tabs 1025 are disposed on a top plate 1030. Angle stock 1035 is disposed on a bottom portion of the floor 1005. Each mounting tab 1025 may be coupled to a corresponding head mounting tab 160, for instance, via a nut and bolt or other fastener. The angle stock 1035 is configured to cooperate with the bottom plate 110 of the dredging head 100.

Figure 11:
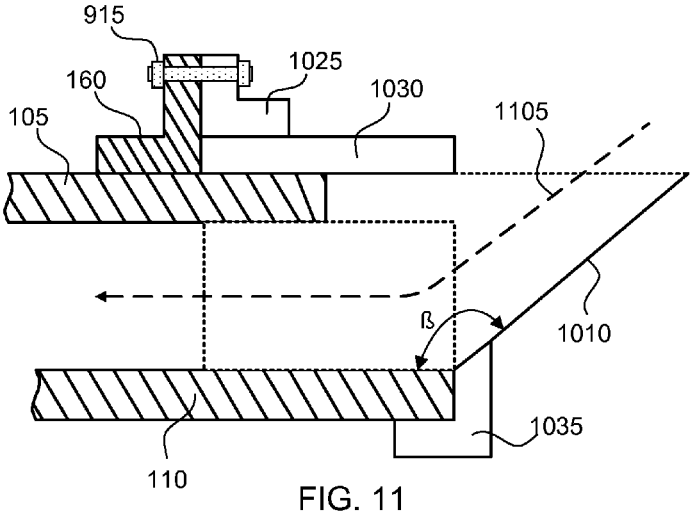
FIG. 11 is a cut-away elevation view of a slope adaptor assembled to a dredging head, according to an embodiment of the invention.

FIG. 11 is a cut-away elevation view of a slope adaptor assembled to a dredging head, according to an embodiment of the invention. As illustrated in FIG. 11, the sloped front 1010 is preferably disposed at interior angle $\beta$ that is greater than 90 degrees with respect to the floor 1005 to achieve desired fluid flow characteristics. FIG. 10 illustrates that a fastener 915 may be used to secure each mounting tab 1025 to a corresponding head mounting tab 160. In operation, slurry is received in a direction 1105 through the slope adapter 1000 and into the intake 115 of the dredging head 100.

Figure 12:
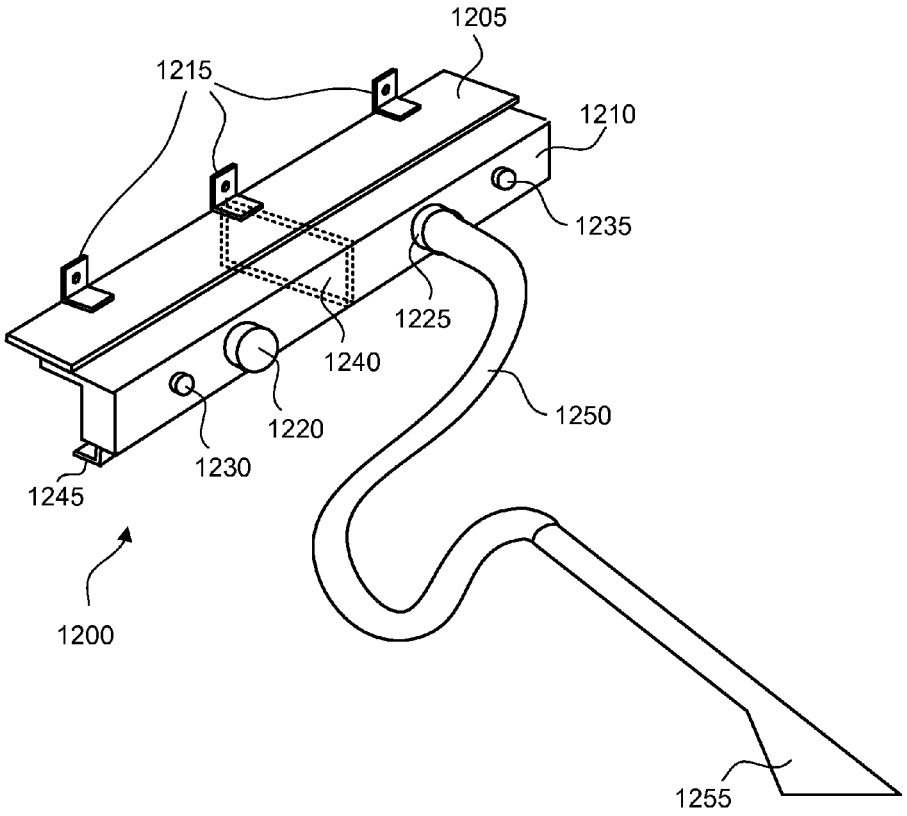
FIG. 12 is a perspective view of a vacuum adapter, according to an embodiment of the invention.

FIG. 12 is a perspective view of a vacuum adapter, according to an embodiment of the invention. In the illustrated embodiment, the vacuum adapter 1200 includes a top plate 1205 and a front plate 1210. Mounting tabs 1215 are disposed on a top surface of the top plate 1205. Vacuum ports 1220, 1225 and pressure relief valves 1230, 1235 are disposed in the front plate 1210. An internal baffle 1240 (illustrated as a hidden feature in FIG. 12) separates an internal cavity of the vacuum head 1200. Angle iron 1245 is disposed on a bottom side of the vacuum adapter 1200. In the illustrated embodiment, a vacuum hose 1250 is connected to the vacuum port 1225, and a wand 1255 is connected to the vacuum hose 1250.

In operation, the vacuum adapter 1200 is coupled to the dredging head 100 (not shown in FIG. 12, but described above), for instance by cooperation of tabs 1215 and tabs 160, and via cooperation of the angle iron 1245 with the bottom plate 110. Such coupling is similar to the assembly technique illustrated in FIGS. 8 and 10. Vacuum pump 125 causes suction at a tip of the wand 1255. Accordingly, slurry progresses through the wand 1255 and hose 1250, the vacuum port 1225 of the vacuum adapter 1200, the intake 155, the vacuum pump 125, and the discharge hose 305.

If the wand 1255 or hose 1250 becomes blocked, the pressure relief valve 1235 is configured to open, allowing fluid flow through the pressure relief value 1235 into the intake 155, thus protecting the suction pump 125. Otherwise the pressure relief valve 1235 remains closed.

Internal baffle 1240 cooperates with a center baffle 115 to effectively split the intake 155 of the dredging head 100. Such configuration isolates the operation of the vacuum ports 1220 and 1225 so they may be used in the alternative (as illustrated in FIG. 12) or in combination. When a single vacuum port is being used, a vacuum pump 125 associated with the non-used vacuum port is preferably deactivated.

Variations to the configuration illustrated in FIG. 12 are possible. For instance, in an alternative embodiment, the internal baffle 1240, one of the vacuum ports 1220, 1225, and one of the pressure relief valves 1230, 1235, could be eliminated. Another embodiment could be configured with three or more vacuum ports and two or more internal baffles, for instance where the vacuum adapter is coupled to a dredging head having three or more vacuum pumps.

When coupled to the dredging head 100, the floor adapter 600 or modified floor adapter 700 advantageously facilitates the collection of sediments or other materials from a body of water without scraping the floor. The slope adapter 1000 facilitates the collection of sediments or other materials from sloped surfaces (at the edge of a man-made pond, for instance). The slope adapter 1000 may also be used to remove sediments from a pile of sediment, for example. The vacuum adapter facilitates the collection of sediments or other materials around dock structures, along uneven shorelines, between large rocks, or around other obstacles. The use of adapters 600, 700, 1000, and/or 1200 thus expands the flexibility and utility of the dredging head 100 and provides a cost advantage compared to a dredging apparatus of fixed configuration.

It will be apparent to those skilled in the art that modifications and variations can be made without deviating from the spirit or scope of the invention.

In one respect, alternative features described herein could be combined in ways not explicitly illustrated. As an example, the dredging head 100 could be outfitted with both the water jet assembly 200 and the floor adapter 600. Alternatively, the dredging head 100 could be outfitted with both the water jet assembly 200 and the slope adapter 1000.

In another respect, individual features described above could be modified. For instance, any of the adapters (600, 700, 1000, and/or 1200) could be attached to the dredging head 100 without the use of mounting tab and/or angle iron features. Instead, as an example, adapters 600, 700, 1000 and/or 1200 could be bolted or otherwise fastened directly to the top plate 105 and/or side walls 415 of the dredging head 100.

Thus, it is intended that the present invention cover any such modifications and variations of this invention provided they come within the scope of the appended claims and their equivalents.

The invention claimed is:

1. A dredging head comprising:

a top plate having a first cutout;

a bottom plate coupled to the top plate, a cavity being formed between the top plate and the bottom plate, the cavity having a side intake;

a first suction pump coupled to the first cutout at an inlet port of the first suction pump;

a first motor coupled to the first suction pump, the first motor configured to drive the first suction pump;

at least one wheel assembly coupled to the top plate and the bottom plate; and, a removable adapter coupled to the side intake, the removable adapter including:

a front plate;

a first vacuum port disposed on the front plate, the first vacuum port configured to receive a vacuum hose assembly, the vacuum hose assembly including a vacuum hose and a wand;

a first pressure relief valve disposed on the front plate, the first pressure relief valve being configured to open if the vacuum hose assembly is coupled to the first vacuum port and the vacuum hose or the wand become clogged in operation;

a second vacuum port disposed on the front plate, the second vacuum port configured to receive the vacuum hose assembly;

a second pressure relief valve disposed on the front plate, the second pressure relief valve being configured to open if the vacuum hose assembly is coupled to the first vacuum port and the vacuum hose or the wand become clogged in operation; and an internal baffle disposed internal to the removable adapter and coupled to the front plate, the internal baffle dividing the side intake into a first side intake portion and a second side intake portion, the first side intake portion being associated with the first vacuum port and the first pressure relief valve the second side intake portion being associated with the second vacuum port the second pressure relief valve, the removable adapter thus configured such that the first vacuum port and the first pressure relief value function independently from the second vacuum port and the second pressure relief valve.

2. The dredging head of claim 1, wherein the first motor is a hydraulic motor.

3. The dredging head of claim 1, further comprising at least one baffle disposed in the cavity, the at least one baffle being coupled to the top plate and the bottom plate.

4. The dredging head of claim 1, wherein the top plate includes a second cutout, the dredging head further comprising:

a second suction pump coupled to the second cutout at an inlet port of the second suction pump; and a second motor coupled to the second suction pump, the second motor configured to drive the second suction pump.

* * * * *